US008656976B2

(12) United States Patent
Hu

(10) Patent No.: US 8,656,976 B2
(45) Date of Patent: Feb. 25, 2014

(54) SWITCHING DUAL CAM ADHESIVE TAPE DISPENSER

(75) Inventor: Jia Hu, Mounds View, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 138 days.

(21) Appl. No.: 13/178,896

(22) Filed: Jul. 8, 2011

(65) Prior Publication Data

US 2012/0018087 A1 Jan. 26, 2012

Related U.S. Application Data

(60) Provisional application No. 61/365,957, filed on Jul. 20, 2010.

(51) Int. Cl.

| | |
|---|---|
| ***B29C 65/00*** | (2006.01) |
| ***B32B 37/00*** | (2006.01) |
| ***B32B 38/04*** | (2006.01) |
| ***B32B 38/10*** | (2006.01) |

(52) U.S. Cl.

USPC ..... 156/523; 156/574; 156/579; 156/270; 225/56; 206/441

(58) Field of Classification Search

USPC ..... 156/523, 527, 574, 579, 270; 225/39, 225/44, 45, 56, 67, 72, 91; 206/411

See application file for complete search history.

(56) References Cited

U.S. PATENT DOCUMENTS

| | | | | |
|---|---|---|---|---|
| 2,606,682 | A * | 8/1952 | Cutter | 156/523 |
| 3,106,324 | A * | 10/1963 | Fritzinger | 225/26 |
| 3,619,324 | A * | 11/1971 | Sato et al. | 156/384 |
| 4,097,328 | A | 6/1978 | Urushizaki | |
| 4,111,736 | A * | 9/1978 | Hamisch, Jr. | 156/384 |
| D328,097 | S | 7/1992 | Czech | |
| D337,787 | S | 7/1993 | Oga et al. | |
| 5,326,421 | A * | 7/1994 | Taylor | 156/526 |
| D438,567 | S | 3/2001 | Van Den Berg | |
| D448,416 | S | 9/2001 | Kimura | |
| D449,858 | S | 10/2001 | Liu | |
| D466,939 | S | 12/2002 | Lee | |
| D475,744 | S | 6/2003 | De Man et al. | |
| D475,746 | S | 6/2003 | Ono | |
| D485,302 | S | 1/2004 | Bain | |
| D492,355 | S | 6/2004 | Suzuki | |
| D494,623 | S | 8/2004 | Huang | |
| D508,085 | S | 8/2005 | Herrmannsen et al. | |
| D515,136 | S | 2/2006 | Herrmannsen et al. | |
| 7,320,351 | B2 | 1/2008 | Chern | |
| D570,919 | S | 6/2008 | Chan et al. | |

(Continued)

OTHER PUBLICATIONS

US 61/327,125, Joel K. Hagglund, Gerald E. Mueller, Joy A. Packard, Arthur V. Lang, Jia Hu, Apr. 23, 2010.

*Primary Examiner* — Linda L. Gray

(74) *Attorney, Agent, or Firm* — Stephen F. Wolf; Robert H. Jordan

(57) ABSTRACT

An adhesive tape dispenser is provided that is operable by a single hand, and is applicable to a variety of adhesive tapes. The provided adhesive tape dispenser overcomes the problem of jamming due to tape accumulation behind the blade by providing a switchable double cam system that allows adhesive tape to be dispensed, the cutter blade to be urged suddenly downward to cut the tape, and then the cutter blade suddenly retracted during one rearward motion of the tape-cutting button.

10 Claims, 7 Drawing Sheets

(56) References Cited

U.S. PATENT DOCUMENTS

D588,645 S 3/2009 Burton et al.
7,610,665 B2 * 11/2009 Casaldi et al. ..... 29/428
D634,784 S 3/2011 Trotter et al.
2002/0059984 A1 * 5/2002 Goodwin et al. ..... 156/577

* cited by examiner

SWITCHING DUAL CAM ADHESIVE TAPE DISPENSER

CROSS REFERENCE TO RELATED APPLICATION

This application claims the benefit of U.S. Provisional Patent Application No. 61/365,957, filed Jul. 20, 2010, the disclosure of which is incorporated by reference herein in its entirety.

FIELD

The present disclosure relates to adhesive tape dispensers and more particularly adhesive tape dispensers that include a switching dual cam and can dispense adhesive tape with one hand operation.

BACKGROUND

Adhesive tape dispensers are well known devices. For example, U.S. Pat. No. 4,097,328 (Urushizaki) teaches an adhesive tape dispenser used to apply cellophane adhesive tape and to automatically cut it. The tape dispenser includes a spring-loaded swing member, a tape press roller mounted on the bottom of the swing member, and a blade-carrying disc mounted to be rotatable as the swing member is pivoted up and down. U.S. Pat. No. 7,320,351 (Chern) teaches an adhesive tape dispenser that includes a housing comprising a rear spring, a forward opening, and a forward tape press roller; a tape dispensing unit urged by the spring and comprising a tape mount with an adhesive tape roll rotatably put thereon; a push member projected from the opening; and a cutter unit pivotably mounted in the housing comprising a front cutting blade and a top ridge. Placing the cutter on a surface to be sealed with the tape slightly projected from the opening and adhered on the surface and sliding the cutter will press the tape against the surface by the tape press roller for adhering thereto. After dispensing a desired length of the tape, pushing the push member will cause it to press down and pass over the ridge and press the blade to cut the tape off its roll with the spring being compressed. This adhesive tape dispenser is capable of being operated with one hand.

FIG. 1 is a perspective view of a tape cutter (adhesive tape dispenser) disclosed in U.S. Pat. No. 7,320,351 (Chern) with the side plate removed. The cutter comprises a housing 101 consisting of two mated side plates. Within the housing 101 there is provided at least one tab at one side plate, each tab adapted to snugly insert into a hole (not shown) at the other side plate for fastening both side plates together, bar 113 projected forwardly from a rear end, a first shaft 111 at a forward opening with tape press roller 115 rotatably mounted thereon, and second shaft 112 projected laterally from one side plate.

The cutter further comprises tape dispensing unit 102 including tubular tape mount 121 with an adhesive tape roll to be rotatably put thereon, push member 122 projected from the opening, a tape guide below push member 122 for pressing onto a tape (not shown), and platform 123 a proximate tape guide. The platform 123 and a tape guide are adapted to facilitate the pulling of tape out of the cutter.

The cutter further comprises coil spring 104 put on bar 113 and biased between an inner wall of the cutter and a rear recess of tape dispensing unit 102 such that tape dispensing unit 102 is able to move closer to the inner wall of the cutter by compressing spring 104 in a tape cutting operation after dispensing a tape as detailed later. The cutter further comprises cutter unit 103 having a rear tubular portion rotatably mounted on second shaft 112 and including front cutting blade 131, mounting plate 132 for fixedly fastening blade 131 onto a front end of a block member, and top ridge 134 disposed proximate push member 122.

Referring to FIG. 1, in operation, the cutter is placed on a surface to be sealed with an open end of adhesive tape roll 105 slightly projected from the opening and adhered on the surface. Next, the cutter is made to slide on the surface with tape 105 pressed against the surface by tape press roller 115 for adhering tape 105 to the surface. When a desired length of tape 105 has been put thereon, a user may push member 122 rearward to press down and pass over ridge 134 until ridge 134 is stopped by an edge of the opening. Also, blade 131 is pressed to cut tape 105 off its roll with spring 104 being compressed.

Occasionally, during operation of one-handed adhesive tape dispensers, such as the one discussed above, tape can jam inside of the dispenser causing an inconvenience to the end user. The end user then has to take apart the two halves, rethread the dispenser, and start again. The problem can occur when the end user does not complete the full stroke of the applicator button. When this happens, the blade may still come in contact with the tape and the tape tears. As result, the tape can accumulate behind the blade. When the applicator button is released, the tape can spring forward and hit the blade before it is retracted causing the tape to jam inside of the dispenser.

U.S. Ser. No. 61/327,125 (Hagglund et al.), filed on Apr. 23, 2010, discloses a tape dispenser for single hand operation that overcomes some of these disadvantages. The disclosed tape dispenser resists jamming due to tape accumulation behind the blade by providing a pivotable lever arm on the blade holder assembly that can be urged suddenly downward by contact with a wedge, an upper pin, and a lower pin attached to a back plate when a push button assembly attached to the back plate is urged rearward by a user. The provided adhesive tape dispenser delays contact of the blade with the adhesive tape when the pushbutton assembly is urged rearward compared to the prior art and then quickly cuts the tape. The delayed, quick downward motion of the cutting blade allows for fast cutting action of the blade on the adhesive tape while minimizing the contact time of the blade or parts of the blade assembly with the tape. The minimized contact time can significantly reduce tape jamming inside of the dispenser. However, the disclosed tape dispenser for single handed operation does not completely eliminate tape jams which can occur from blade-tape interference after the tape is cut.

Thus, there is a need for adhesive tape applicators that can be operated with one hand, are simple to operate and manufacture, and which resist jamming due to tape accumulation behind the blade. There is also a need for tape applicators that can eliminate blade-tape interference after the tape is cut.

SUMMARY

The provided adhesive tape dispenser has the advantages of being safe to the user in operation, being operable by a single hand, and being applicable to a variety of adhesive tapes. Additionally, the provided adhesive tape dispenser overcomes the problem of jamming due to tape accumulation behind the blade by providing a switchable double cam system that allows adhesive tape to be dispensed, the cutter blade to be urged suddenly downward to cut the tape, and then the cutter blade suddenly retracted during one rearward motion of the tape-cutting button. Unlike the prior art, the provided adhesive tape dispenser, with its one motion down and up blade operation, significantly reduces the contact of the blade with the adhesive tape, thus significantly reducing, if not eliminating, blade-tape interference after the tape is cut.

In one aspect, an adhesive tape dispenser is provided that includes a lower housing having a perimeter, the lower housing comprising an inner edge, an inner wall, at least two alignment features, a forward tape press roller, a pivot post, at least two forward lateral ridges defining a forward recessed groove, and at least two rear lateral ridges defining a rear recessed groove, wherein the inner edge substantially surrounds the perimeter of the lower housing except for one section that defines a forward opening, and wherein the forward tape press roller, the pivot post, and the forward lateral ridges project inwardly from the inner wall of the lower housing; a back plate assembly comprising a back plate having a inner side and an outer side, the inner side that includes a tape unwind spool, a push button attached to and projecting inward from the back plate, at least one forward and one rear tab that each slideably engage the forward recessed groove and the rear recessed grove of the lower housing, respectively, and a slide pin projecting inward from the back plate; an outer cam assembly that includes a lever arm having a proximal end and a distal end, a pivot cylinder on the proximal end of the lever arm, and a cutting blade mounted on the distal end of the lever arm, the pivot cylinder rotatably engaging the pivot post on the lower housing, wherein the lever arm includes an outer cam opening towards the distal end which engages the slide pin of the back plate assembly; and an inner cam assembly that includes a pivot arm having a proximal end and a distal end, a pivot cylinder on the proximal end of the pivot arm, a switching bar attached to the outer side of the pivot cylinder, and a pusher at the distal end of the pivot arm, wherein the pivot cylinder rotatably engages the pivot post on the lower housing on the inside of the outer cam assembly lever arm, and wherein the pusher at the distal end of the pivot arm extends outwardly into the outer cam opening of the outer cam assembly. The provided tape dispenser can include an upper housing that can be aligned with the inner housing at least two alignment features. After alignment, the upper housing and the lower housing can substantially encase the backplate assembly, the outer cam assembly and the inner cam assembly.

In another aspect, a method of cutting and adhesive tape is provided that includes the use of a provided adhesive tape dispenser. The cutting blade on the outer cam assembly cuts though the adhesive tape and returns to its precut position when the push button, which can be in a forward or rearward position is urged rearward. The push button can be returned to its forward or precut position by a spring.

In this disclosure:

"cam" refers to a device or device feature that translates one type of motion into another type of motion, for example, circular motion into reciprocating or oscillating motion;

"forward" or "front" refers to the direction towards the dispensing end of the tape dispenser;

"rearward" or "rear" refers to the direction away from the dispensing end of the dispenser;

"inner" refers to the direction or side facing towards the inside of the tape dispenser or upward (towards the observer) in FIG. 2 and FIGS. 3*a*-3*e*; and "outer" refers to the direction or side facing away from the inside of the tape dispenser.

The provided adhesive tape dispenser differs from previous adhesive tape dispensers in that it can be operated with a single hand and, after a desired amount of tape has been dispensed, the tape can be cut by moving a push button from a forward position to a rearward position. During this single motion, the switching dual cam mechanism of the provided tape dispenser forces the cutting blade down through the tape and then immediately raises the cutting blade back into its original position. This quick cutting and return stroke can eliminate blade-tape interference after the tape is cut.

The above summary is not intended to describe each disclosed embodiment of every implementation of the present invention. The brief description of the drawings and the detailed description which follows more particularly exemplify illustrative embodiments.

DETAILED DESCRIPTION

In the following description, reference is made to the accompanying set of drawings that form a part of the description hereof and in which are shown by way of illustration several specific embodiments. It is to be understood that other embodiments are contemplated and may be made without departing from the scope or spirit of the present invention. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

The provided adhesive tape dispenser features a switching dual cam mechanism to allow the desired quick cutting and return stroke to occur during a single unidirectional motion of the push button. The switching dual cam mechanism includes a stationary slide pin and two cam assemblies—an outer cam assembly and an inner cam assembly. Both the outer cam assembly and the inner cam assembly are rotatably attached to the same pivot post at their rearward ends. The outer cam assembly provides an opening that defines the path that the slide pin travels when the push button is moved rearward. The inner cam assembly includes a wedge-shaped template (pusher) that, when down, forces the slide pin to the top of the opening in the outer cam, which in turn forces the outer cam arm with cutting blade attached downward, cutting the tape. As the push button is continued to be moved rearward, a switching tab attached to the push button pushes against a switching bar on the rotatable pivot section of the inner cam assembly. This drives the lever arm or the inner cam assembly upward out of the way of the slide pin and in doing so also pushes against the arch of the opening in the outer cam assembly to raise the cutting blade. Thus, the provided adhesive dispenser includes a switching mechanism (interaction between the push button and the inner cam assembly), and two cams. One cam is provided by the outer cam opening and the other cam is provided by the pusher.

Figure 1:
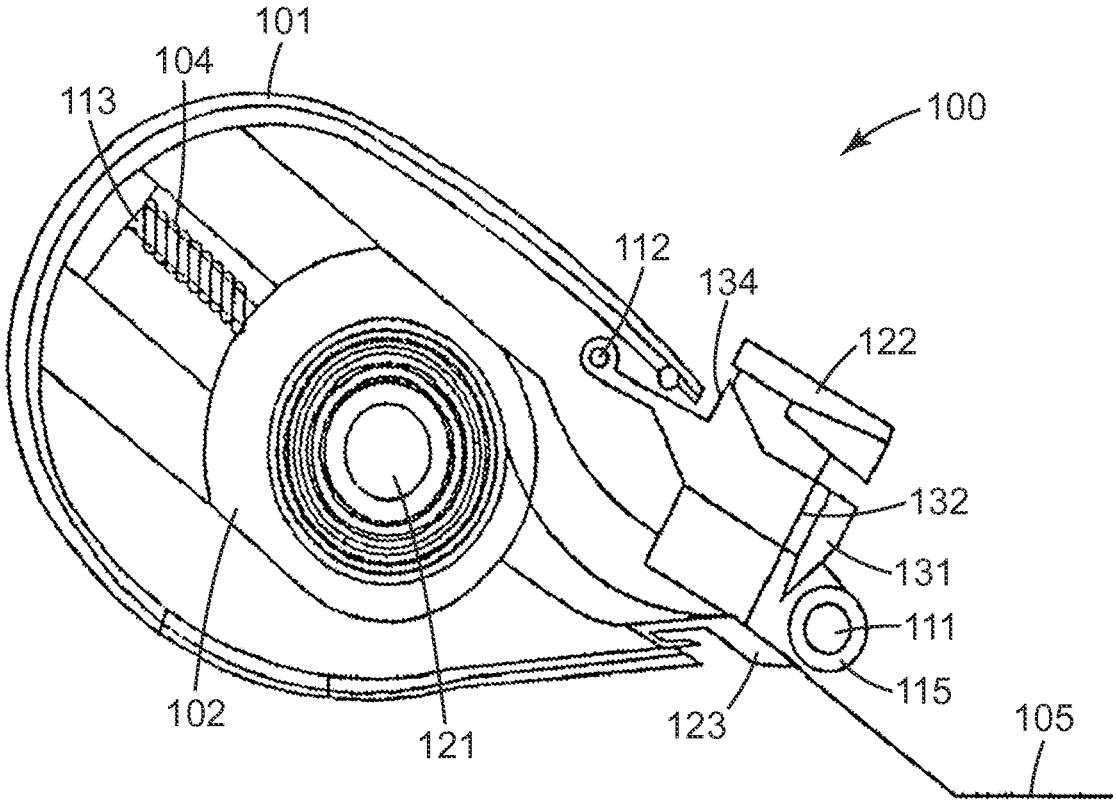
Fig. 1 Prior Art
FIG. 1 is a side view of a tape cutter disclosed in U.S. Pat. No. 7,320,315 with the side plate removed.
Figure 2:
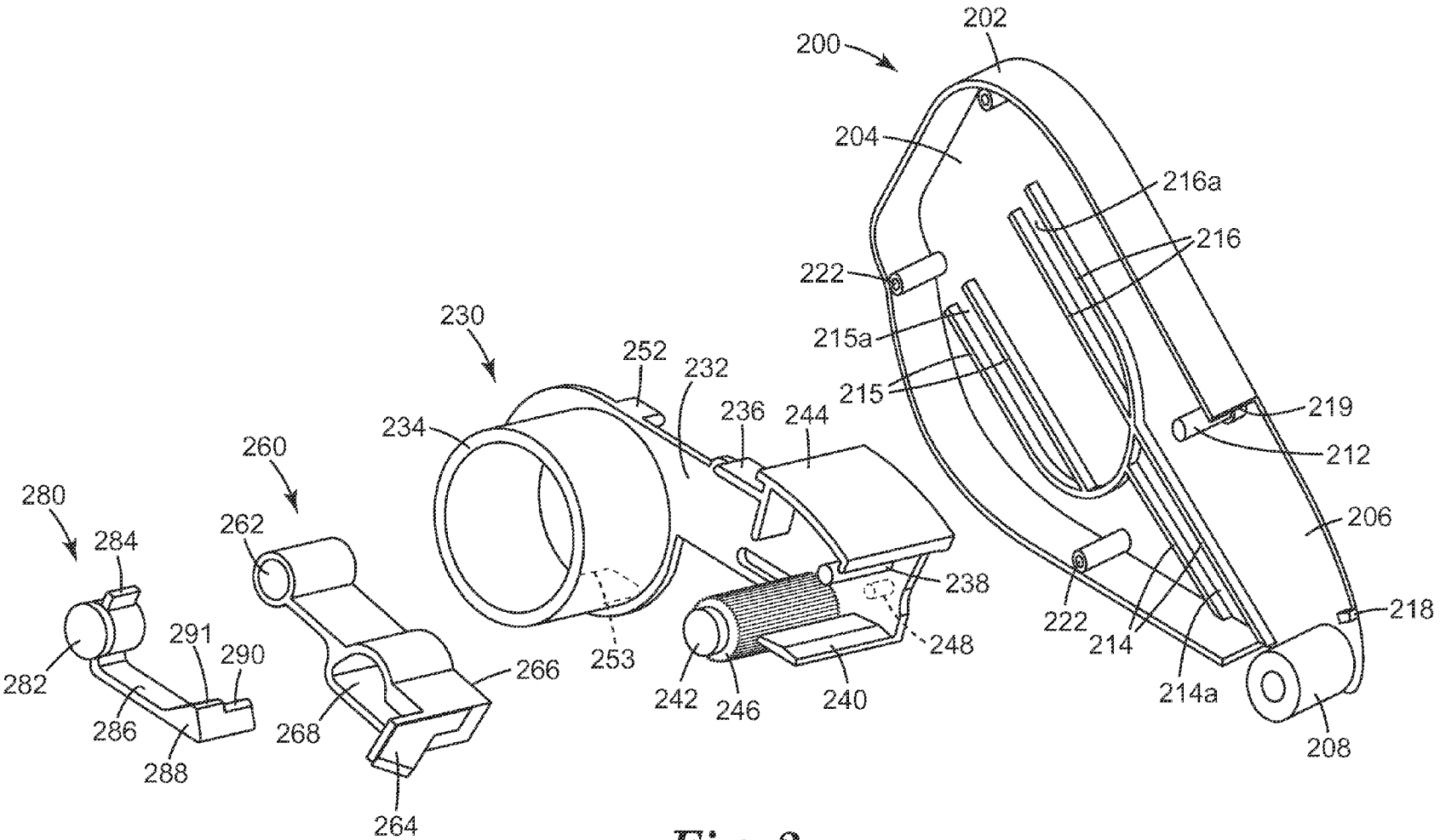
FIG. 2 is an exploded perspective view of an embodiment of a provided adhesive tape dispenser.

Referring to FIG. 2, an exploded perspective view of an embodiment of a provided adhesive tape dispenser is illustrated. The dispenser comprises lower housing 200 designed to fit together with an upper housing (not shown). At least two alignment features (not shown) in the upper housing fit into at least two alignment features in the lower housing. In the embodiment shown in FIG. 2, the alignment features in lower housing 200 include at least two alignment holes 222 and corresponding alignment features in the upper housing (not shown) include at least two location pins. When the lower housing is mated with the upper housing, the upper housing and lower housing 200 substantially contact each other along inner edge 202 of lower housing 200 and a corresponding inner edge on the upper housing. Other alignment features such as, for example, ridges and grooves, interfacing surface features, tabs, recesses, and the like are also contemplated.

The provided adhesive tape dispenser includes lower housing 200, back plate assembly 230, outer cam assembly 260, and inner cam assembly 280. As discussed above, the provided adhesive tape dispenser can also include an upper housing that comprises an inner edge and at least two alignment features, wherein the inner edge upper housing makes contact with the inner edge of the lower housing thereby substantially encasing the back plate assembly and the blade assembly unit.

Lower housing 200 includes inner wall 204 and has inner edge 202 that substantially surrounds the perimeter of lower housing 200. Inner edge 202 matches a similar inner wall on the upper housing to substantially enclose the adhesive tape dispenser working parts to be described herein when the lower housing is mated to the upper housing. Inner edge 202 includes forward opening 206 through which tape can be dispensed and through which push button 244 of back plate assembly 230 can protrude. Lower housing 200 includes pivot post 212 and forward tape press roller 208 projecting inward substantially perpendicular from inner wall 204. Forward tape press roller 208 is located within forward opening 206 and functions to press adhesive tape exiting the dispenser onto a substrate. Lower housing 200 also includes forward lateral ridges 214 that define forward recessed groove 214*a*, and rear lateral ridges 216 projecting inward from inner wall 204. Forward lateral ridges 214 and rear lateral ridges 215 and 216 that define rear recessed grooves 215*a* and 216*a* respectively. Forward lateral ridges 210 and rear lateral ridges 215 and 216 are substantially parallel. Forward lateral ridges 214 extends substantially from forward opening 206 to rear lateral ridges 215 and 216 as shown in FIG. 2. Rear lateral ridges 215 and 216 extend rearward in a substantially parallel fashion. Forward tab 248 on back plate assembly 230, engaged with a coil spring (not shown), fits into forward recessed groove 214*a*. Similarly, two rear tabs 252 and 253 on back plate assembly 230 fit into rear recessed grooves 215*a* and 216*a*. Back plate assembly 230 slides on top of forward and rear lateral ridges 214, 215, and 216 and the tabs and grooves confine the sliding motion of back plate assembly 230 into a lateral forward and rear sliding motion. Slide stops (forward slide stop 218 and rear slide stop 219) define the forward and rear slide limits of back plate assembly 230 during operation of the dispenser as illustrated in FIGS. 3*a*-3*e*.

Back plate assembly 230 is slideably engaged in lower housing 200 has described above and can slide forward (towards forward opening 206) or rearward (away from forward opening 206) during operation which is described further within. Back plate assembly 203 includes flat base plate 232 upon which all other features described herein are mounted. Push button 244 is attached to the upper forward part of base plate 232 and protrudes towards the inside of the tape dispenser in a direction substantially normal to base plate 232. Push button 244 protrudes through forward opening 206 of lower housing 200 when back plate assembly 230 is slideably engaged into lower housing 200. Back plate assembly 203 also includes tabs 252 and 253 normal to base plate 232 and protruding outwardly behind base plate 236 as described above. Back plate assembly includes tape spool 234 also mounted in a direction normal to the inner surface of base plate 232 upon which rolls of pressure-sensitive adhesive tape are be mounted. Switching tab 236 is mounted normal to the inner surface of base plate 232 upon back plate assembly 230 rearward of push button 244 and, when the provided adhesive tape dispenser is assembled, contacts and pushes against switching bar 284 of inner cam assembly 280 when back plate assembly is urged rearward. Its operation is more fully described later on. Back plate assembly also includes slide pin 238 that is mounted inwardly normal to base plate 232. Slide pin 238 slideably engages outer cam opening 268 of outer cam assembly 260 when the provided tape dispenser is fully assembled. Back plate assembly 230 also includes tape hold down roller 246 also mounted normal to base plate 232 that has a cylindrical opening that fits around roller pin 242 so that it can rotate freely when tape is being dispensed. Tape hold down roller 246 holds tape down when cutting action is employed. Finally, back plate assembly 230 includes tape guide 240 over which tape is dispensed. Tape guide 240 is mounted normal to base plate 232. The function of tape guide 240 is to guide the tape through forward opening 206 of lower housing 200 and to hold the tape during the cutting operation described herein.

The provided tape dispenser also includes outer cam assembly 260. Outer cam assembly 260 includes pivot cylinder 262 and lever arm 266. Lever arm 266 includes outer cam opening 268 (described later on) as a part of lever arm 266 and also includes cutting blade 264 mounted on the end or distal portion of lever arm 266. When the provided tape dispenser is assembled, outer cam assembly 260 is mounted inwardly from back plate assembly 230 so that pivot cylinder 262 of outer cam assembly 260 is mounted on pivot post 212 of lower housing 200 and slide pin 238 on back plate assembly 230 fits into outer cam opening 268 as shown in FIGS. 3-5.

The provided tape dispenser also includes inner cam assembly 280. Inner cam assembly 280 includes a pivot cylinder (not shown but underneath pivot cylinder cap 282), switching bar 284, inner cam lever arm 286 and pusher 288. Pusher 288 is on the forward end of inner cam lever arm 286. Pusher 288 has recessed cut 290 on its outer side (the side towards the lower housing). Recessed cut 290 is illustrated compared to the upper outer end of pusher 288 which is shown as 291. Recessed cut 290 extends from the upper outer end of pusher 288 down the rearward side of pusher 288 and allows for passage of slide pin 238 during operation of the dispenser. This is further illustrated in the description of FIGS. 3*a*-3*e*. When the provided tape dispenser is assembled, inner cam assembly 280 is mounted inward of outer cam assembly 260. Pivot cylinder of outer cam assembly (not shown) is also mounted on pivot post 212 of lower housing. Pusher 288 (described herein) is slideably engaged inside of outer cam opening 268 and either over or under slide pin 238 of back plate assembly 230 depending upon position of switching bar 284.

The operation of the provided switching dual cam tape dispenser is herein described for one embodiment of the provided adhesive tape dispenser. The operation of the dispenser is based upon a back plate assembly that can be slideably urged forward and rearward in a lower housing by a rigidly attached push button. In some embodiments, the push button can be fabricated as a contiguous part of the back plate assembly. A slide pin is also a part of the back plate assembly. When the push button is urged rearward after dispensing a desired amount of tape, the slide pin moves from start position, over an inner cam and pushes down on an outer cam. The outer cam has a cutting blade bonded to its forward surface. Once the slide pin moves over the top of the inner cam, the outer cam is at its lowest position and the cutting motion is complete. As the push button is urged further rearward, a switching tab on the push button engages a switching bar on the arm of the inner cam thus urging the inner cam upwards. When the inner cam reaches the arch of the outer cam, it pushes the outer cam arm (with cutting blade attached) upwards to its starting position, thus ending the cutting stroke and moving the blade out of the way of the tape's returning route.

The slide pin moves underneath the inner cam in a direct route towards its starting position when the push button is returned to its forward position either by the user or via an optional spring. As soon as the slide pin clears the inner cam, a pusher on the inner cam lever arm pushes the inner cam back to its starting position as the slide pin returns to its starting position, thus completing the return stroke. The whole operation is best illustrated by referring to FIGS. 3*a*-3*e*. The reference numbers used in FIGS. 3*a*-3*e* correspond to the same numbers and parts referred to above for FIG. 2.

Figure 3A:
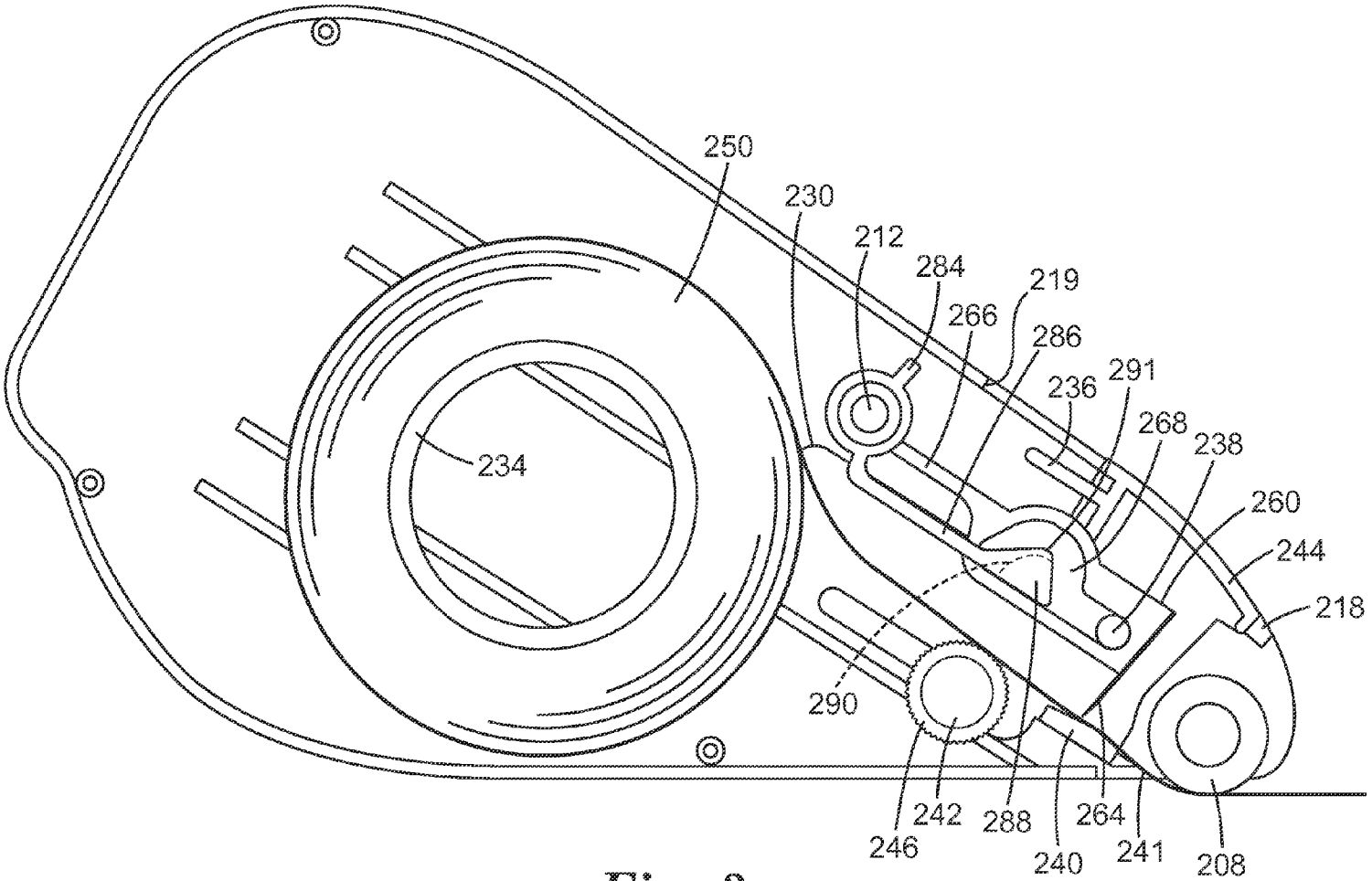
FIGS. 3*a*-3*e* drawings, that are sequential in time, illustrating the operation of a provided adhesive tape dispenser.

FIG. 3*a* is a schematic view of an embodiment of a provided adhesive tape dispenser in its pre-cut position. Tape spool 234 has tape roll 250 mounted thereon. Adhesive tape 241 is unwound from tape roll 250, passes over tape hold down roller 246, between cutting blade 264 (shown in its upward position) and tape guide 240, and then emerges from the adhesive tape dispenser and passes under forward tape press roller 208. In this position, tape can be applied to a substrate (not shown) using a single hand by drawing the adhesive tape dispenser rearward (in the left hand direction as illustrated) while pressing down on the adhesive tape dispenser which puts pressure on forward tape press roller 208. In its pre-cut position, push button 244 (attached to back plate assembly 230) is in its forward position against forward slide stop 218, slide pin 238 is in its most forward position in outer cam opening 268 and inner cam lever arm 286 is located in the rearward position of outer cam opening 268 in its downward position. Outer cam opening 268 has a flat bottom edge and is narrow at its forward end (just large enough to allow slide pin 238 to freely slide within it) but has an enlarged opening at its rearward end (that allows pusher 288 which is engaged in outer cam opening 268) to be in a downward position (as shown in FIG. 3*a*) or an upward position (against the top of the enlarged opening). Both outer cam assembly 260 and inner cam lever arm are rotatably mounted on pivot post 212 of the lower housing.

Figure 3B:
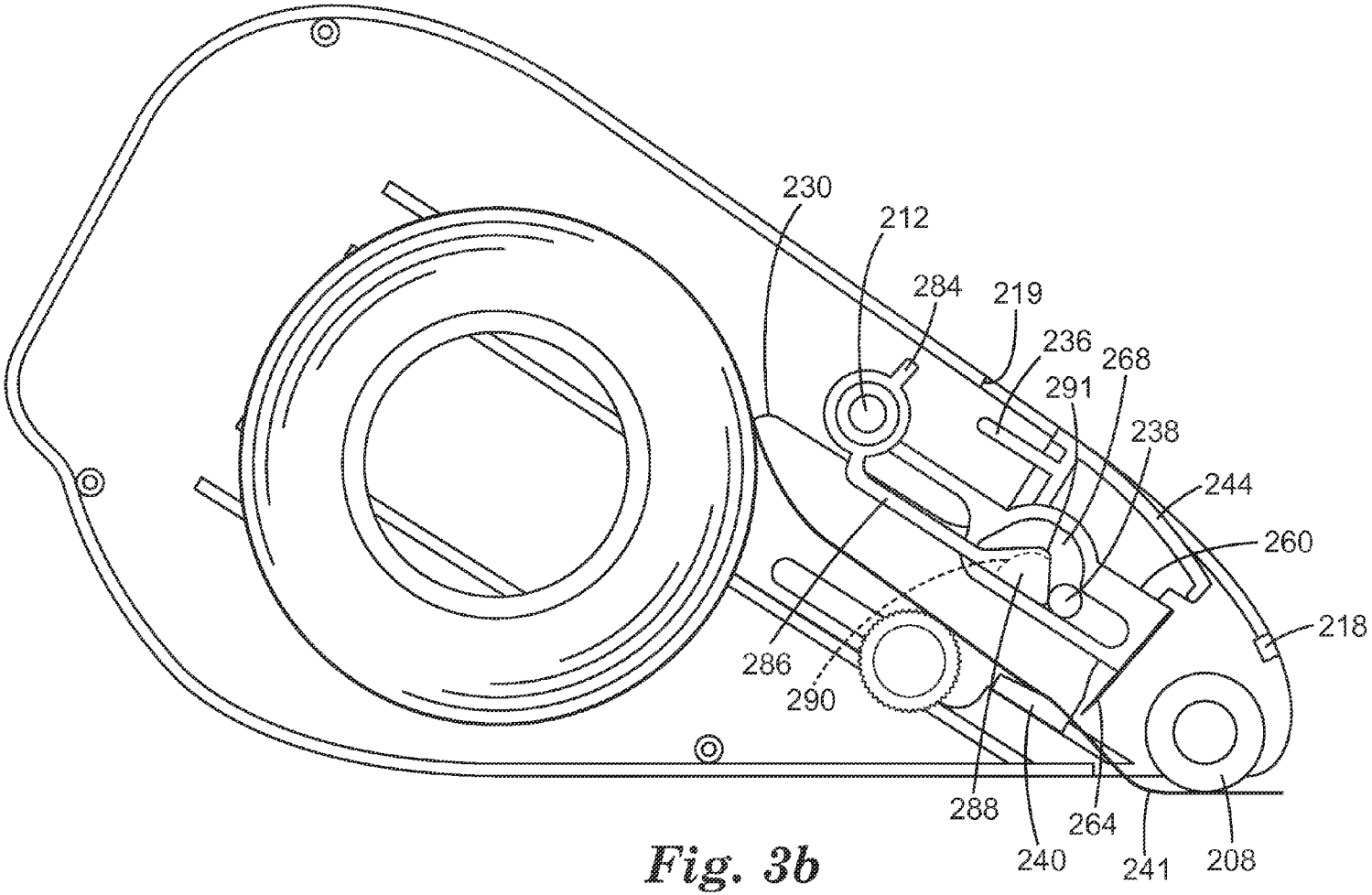

When a desired amount of tape has been applied to the substrate, push button 244 is urged rearward and passes through a position captured by FIG. 3*b*. In this position, cutting blade 264 is still in its pre-cut position as shown. As push button 244 is urged rearward, slide pin 238 travels on the flat bottom edge of outer cam opening 268 until it encounters pusher 288. Pusher 288 forces slide pin 238 towards the top of the enlarged opening of outer cam opening 268 as push button 244 is urged farther rearward.

Figure 3C:
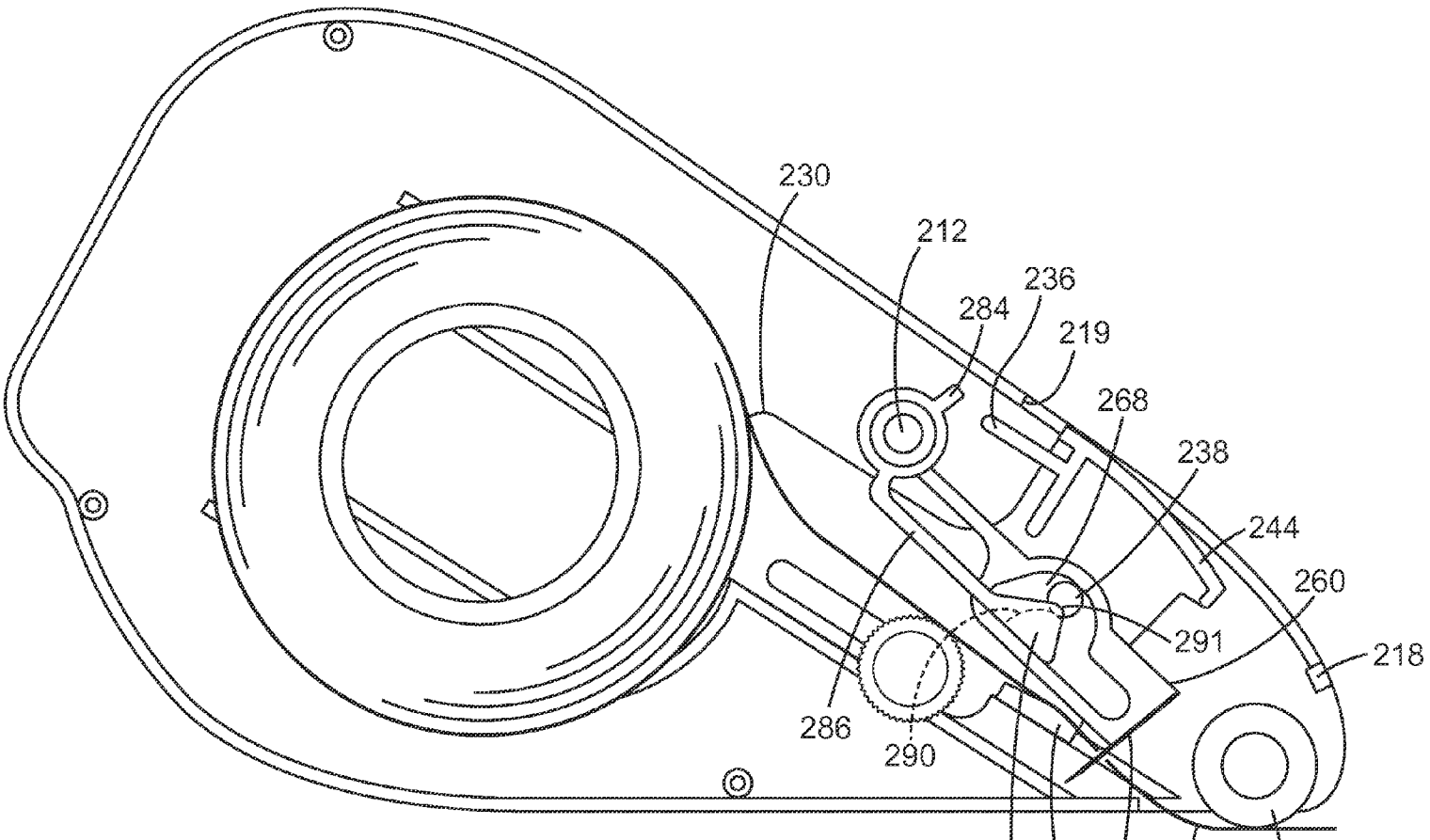

FIG. 3*c* illustrates further rearward urging of push button 244. In this illustration, pusher 288 has forced slide pin 238 into the upward part of the enlarged opening of outer cam opening 268. Since outer cam assembly 260 is rotatably mounted on pivot post 212 and slide pin 238 is in a relatively fixed position (attached to back plate assembly 230 and thus, push button 244), outer cam assembly 260 is forced downward by slide pin 238 (which is against the roof of enlarged opening of outer cam opening 268) and pusher 288 (that has recessed cut 290 on its outer side to allow passage of slide pin 238). This downward motion of outer cam assembly 260 forces cutting blade 264 downward cutting the adhesive tape.

Figure 3D:
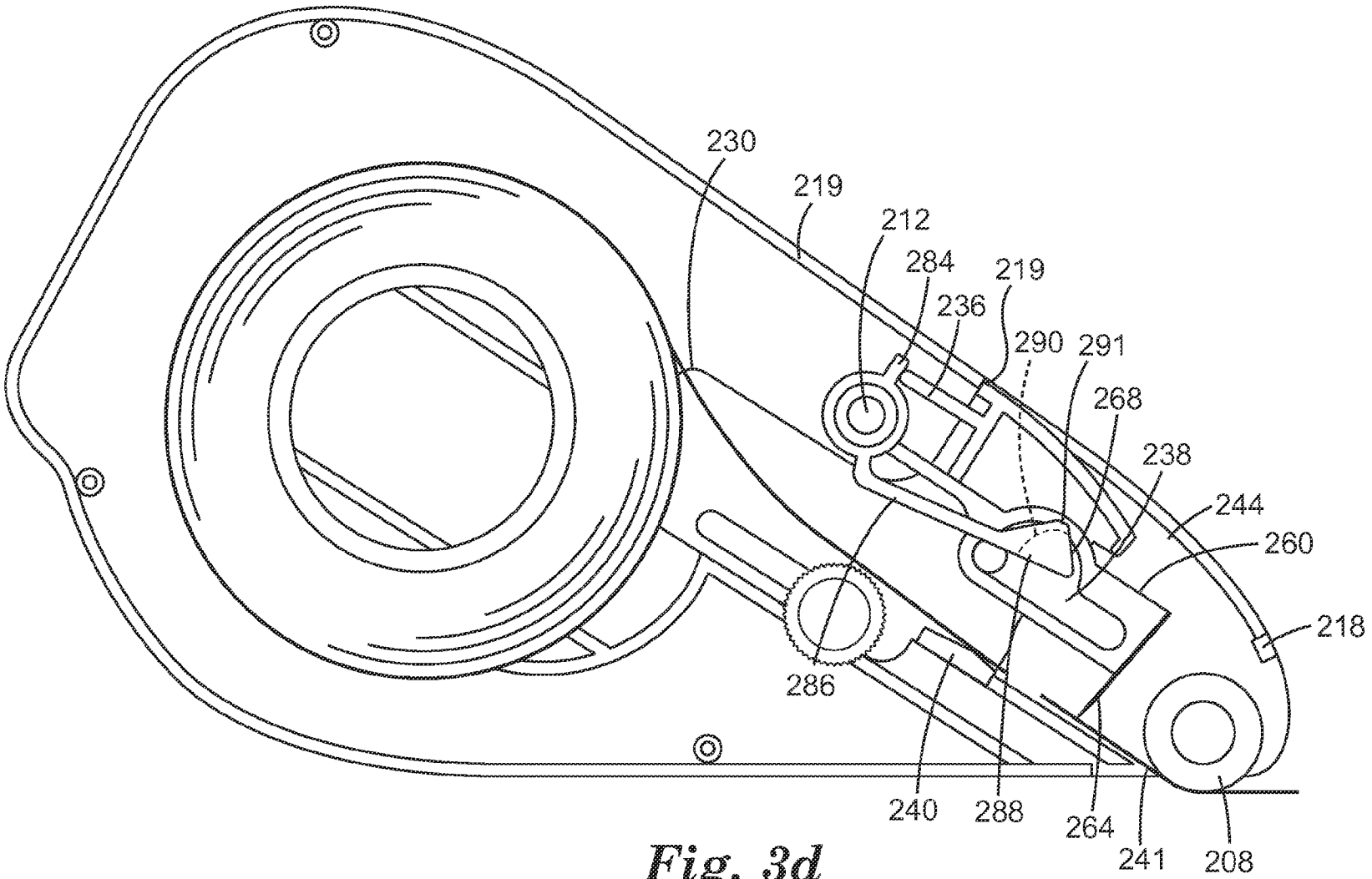

Further rearward motion of push button 244 puts it into its most rearward position, against rear slide stop 219 as illustrated in FIG. 3*d*. In this position, switching bar 284 (connected to inner cam lever arm 286) has been forced rearward by contact with switching tab 236 attached to push button 244. Since inner cam lever arm 286 is attached to switching bar 284, this action forces pusher 288 upward which in turn forces outer cam assembly upward until slide pin 238 is against the rearward most portion of the flat bottom edge of outer cam opening 268. This action lifts cutting blade 264 up into its pre-cut position as shown.

Figure 3E:
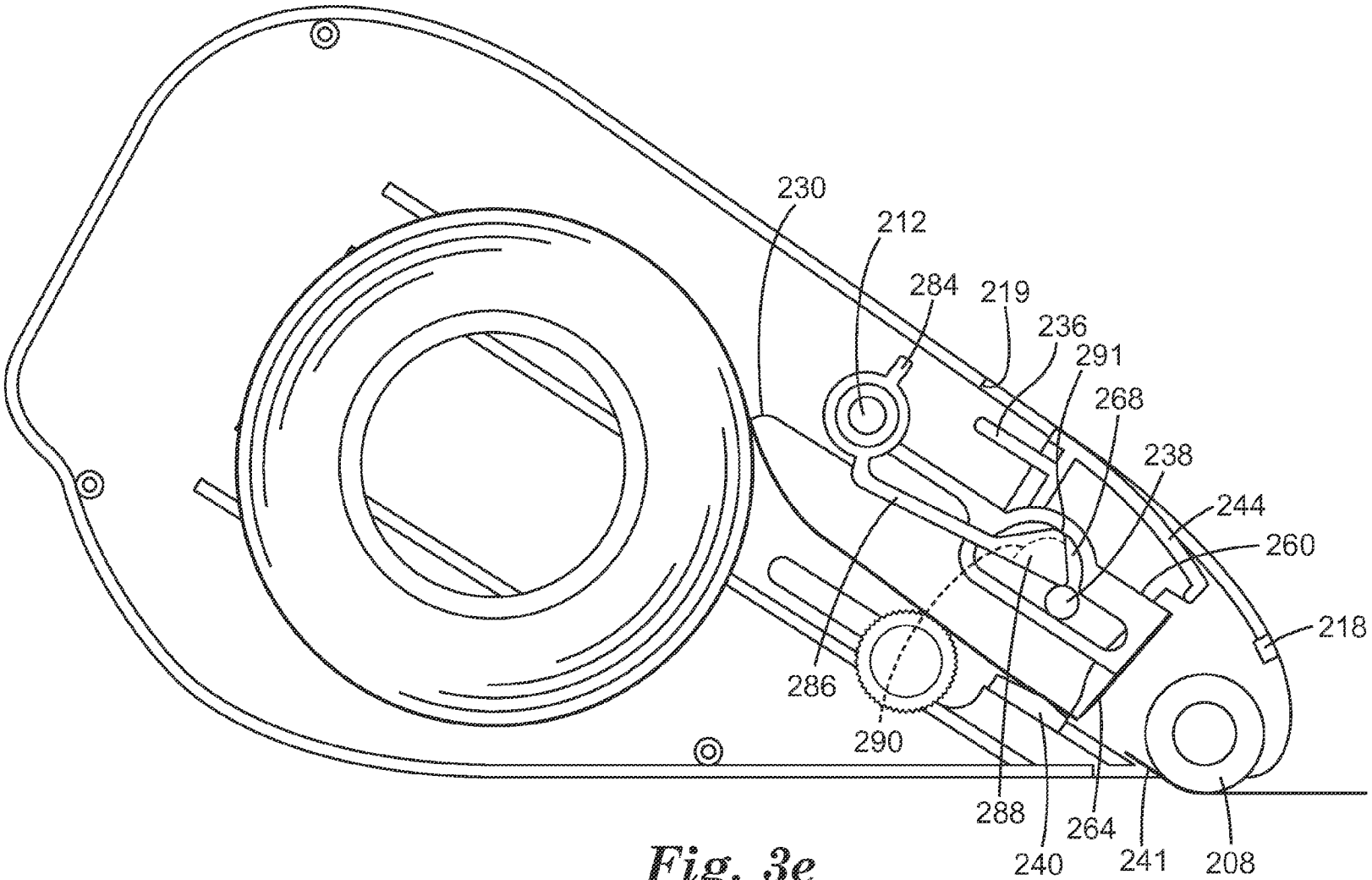

FIG. 3*e* is an illustration of the provided adhesive tape dispenser as push button 244 is urged forward again (by a user, a spring, or a combination thereof). As push button 244 is urged forward, slide pin 238 now travels the whole distance from its most rearward position (FIG. 3*d*) to its most forward position (FIG. 3*a*) against the flat bottom edge of outer cam opening 268. Pusher 288 remains it its upward position as slide pin 238 keeps it in its upward position. This keeps outer cam assembly also in its upward position and keeps cutting blade 264 also in its upward position.

Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows. All references cited in this disclosure are herein incorporated by reference in their entirety.

What is claimed is:

1. An adhesive tape dispenser comprising:

a lower housing having a perimeter, the lower housing comprising an inner edge, an inner wall, at least two alignment features, a forward tape press roller, a pivot post, at least two forward lateral ridges defining a forward recessed groove, and at least two rear lateral ridges defining a rear recessed groove, wherein the inner edge substantially surrounds the perimeter of the lower housing except for one section that defines a forward opening, and wherein the forward tape press roller, the pivot post, and the forward lateral ridges project inwardly from the inner wall of the lower housing;

a back plate assembly comprising a back plate having a inner side and an outer side, the inner side that includes a tape unwind spool, a push button attached to and projecting inward from the back plate, at least one forward and one rear tab that each slideably engage the forward recessed groove and the rear recessed grove of the lower housing, respectively, and a slide pin projecting inward from the back plate;

an outer cam assembly that includes a lever arm having a proximal end and a distal end, a pivot cylinder on the proximal end of the lever arm, and a cutting blade mounted on the distal end of the lever arm, the pivot cylinder rotatably engaging the pivot post on the lower housing, wherein the lever arm includes an outer cam opening towards the distal end which engages the slide pin of the back plate assembly; and an inner cam assembly that includes a pivot arm having a proximal end and a distal end, a pivot cylinder on the proximal end of the pivot arm, a switching bar attached to the outer side of the pivot cylinder, and a pusher at the distal end of the pivot arm, wherein the pivot cylinder rotatably engages the pivot post on the lower housing on the inside of the outer cam assembly lever arm, and wherein the pusher at the distal end of the pivot arm extends outwardly into the outer cam opening of the outer cam assembly.

2. An adhesive tape dispenser according to claim 1, further comprising an upper housing that comprises an inner edge and at least two alignment features, wherein the inner edge upper housing makes contact with the inner edge of the lower housing thereby substantially encasing the back plate assembly, the outer cam assembly, and the inner cam assembly.

3. An adhesive tape dispenser according to claim 1, wherein the forward lateral ridges and the rear lateral ridges of the lower housing are substantially parallel.

4. An adhesive tape dispenser according to claim 1, wherein the wall of the lower housing comprises a forward slide stop.

5. An adhesive tape dispenser according to claim 1, wherein the inner edge of the lower housing comprises a rear slide stop.

6. An adhesive tape dispenser according to claim 1, wherein the back plate assembly further comprises a tape hold down roller projecting inward from the front end of the back plate.

7. An adhesive tape dispenser according to claim 1, further comprising a tape guide attached to and projecting from the front end of the back plate.

8. An adhesive tape dispenser according to claim 1, wherein the back plate assembly further comprises a coil spring within the forward recessed groove of the lower housing that engages the forward tab of the back plate assembly.

9. A method of cutting an adhesive tape using an adhesive tape dispenser according to claim 1, wherein the cutting blade cuts though the adhesive tape and returns to its precut position when the push button, which can be in a forward or rearward position, is urged rearward.

10. A method of cutting and adhesive tape using an adhesive tape dispenser according to claim 9, wherein the push button is returned to its forward position by a spring.

* * * * *

UNITED STATES PATENT AND TRADEMARK OFFICE

CERTIFICATE OF CORRECTION

PATENT NO. : 8,656,976 B2
APPLICATION NO. : 13/178896
DATED : February 25, 2014
INVENTOR(S) : Jia Hu It is certified that error appears in the above-identified patent and that said Letters Patent is hereby corrected as shown below:

In the Specification

Column 3,
Line 38, after "housing" insert -- using --. (2nd occurrence)

Signed and Sealed this
Twenty-fourth Day of June, 2014

Michelle K. Lee

Michelle K. Lee
*Deputy Director of the United States Patent and Trademark Office*